US005754208A

United States Patent [19]

Szlucha

[11] Patent Number: 5,754,208

[45] Date of Patent: May 19, 1998

[54] LIQUID INK PRINTER HAVING DRYER WITH INTEGRAL REFLECTOR

[75] Inventor: Thomas F. Szlucha, Fairport, N.Y.

[73] Assignee: Xerox Corporation, Stamford, Conn.

[21] Appl. No.: 562,864

[22] Filed: Nov. 27, 1995

[51] Int. Cl.[6] ..... B41J 2/01

[52] U.S. Cl. ..... 347/102; 347/101

[58] Field of Search ..... 347/102, 101

[56] References Cited

U.S. PATENT DOCUMENTS

| | | | |
|---|---|---|---|
| 4,970,528 | 11/1990 | Beaufort et al. | 347/102 |
| 5,029,311 | 7/1991 | Brandkamp et al. | 355/30 |
| 5,274,400 | 12/1993 | Johnson et al. | 346/140 R |
| 5,287,123 | 2/1994 | Medin et al. | 346/140 R |
| 5,526,190 | 6/1996 | Hubble, III et al. | 347/102 |

*Primary Examiner*—Valerie Lund
*Attorney, Agent, or Firm*—Daniel J. Krieger

[57] ABSTRACT

A printing machine having a dryer for drying liquid ink printing deposited in a print zone on a surface of a recording medium moving along a path. The dryer includes a heat source, generating heat energy, disposed adjacently to the path, for heating the recording medium and drying the ink. A reflector system, including a first reflector and a second reflector, direct the heat energy toward another surface of the recording medium. In one embodiment, the heat source comprises a quartz tube having a reflective coating, acting as the first reflector, deposited on a surface of the tube, and the second reflector directs additional heat energy towards the recording medium.

18 Claims, 3 Drawing Sheets

LIQUID INK PRINTER HAVING DRYER WITH INTEGRAL REFLECTOR

FIELD OF THE INVENTION

This invention relates generally to a liquid ink printing machine and more particularly to a liquid ink printer having a dryer with an integral reflector.

BACKGROUND OF THE INVENTION

Liquid ink printers of the type frequently referred to as continuous stream or as drop-on-demand, such as piezoelectric, acoustic, phase change wax-based or thermal, have at least one printhead from which droplets of ink are directed towards a recording medium. Within the printhead, the ink is contained in a plurality of channels. Power pulses cause the droplets of ink to be expelled as required from orifices or nozzles at the end of the channels.

In a thermal ink-jet printer, the power pulse is usually produced by a heater transducer or a resistor, typically associated with one of the channels. Each resistor is individually addressable to heat and vaporize ink in the channels. As voltage is applied across a selected resistor, a vapor bubble grows in the associated channel and initially bulges from the channel orifice followed by collapse of the bubble. The ink within the channel then retracts and separates from the bulging ink thereby forming a droplet moving in a direction away from the channel orifice and towards the recording medium whereupon hitting the recording medium a drop or spot of ink is deposited. The channel is then refilled by capillary action, which, in turn, draws ink from a supply container of liquid ink.

The ink jet printhead may be incorporated into either a carriage type printer, a partial width array type printer, or a page-width type printer. The carriage type printer typically has a relatively small printhead containing the ink channels and nozzles. The printhead can be sealingly attached to a disposable ink supply cartridge. The combined printhead and cartridge assembly is attached to a carriage which is reciprocated to print one swath of information (having a width equal to the length of a column of nozzles), at a time, on a stationary recording medium, such as paper or a transparency. After the swath is printed, the paper is stepped a distance equal to the height of the printed swath or a portion thereof, so that the next printed swath is contiguous or overlapping therewith. This procedure is repeated until the entire page is printed. In contrast, the page width printer includes a stationary printhead having a length sufficient to print across the width or length of a sheet of recording medium at a time. The recording medium is continually moved past the page width printhead in a direction substantially normal to the printhead length and at a constant or varying speed during the printing process. A page width ink-jet printer is described, for instance, in U.S. Pat. No. 5,192,959.

Many liquid inks and particularly those used in thermal ink jet printing, include a colorant or dye and a liquid which is typically an aqueous liquid vehicle, such as water, and/or a low vapor pressure solvent. The ink is deposited on the substrate to form an image in the form of text and/or graphics. Once deposited, the liquid component is removed from the ink and the paper to fix the colorant to the substrate by either natural air drying or by active drying. In natural air drying, the liquid component of the ink deposited on the substrate is allowed to evaporate and to penetrate into the substrate naturally without mechanical assistance. In active drying, the recording medium is exposed to heat energy of various types which can include infrared heating, conductive heating and heating by microwave energy.

Active drying of the image can occur either during the imaging process or after the image has been made on the recording medium. In addition, the recording medium can be preheated before an image has been made to precondition the recording medium in preparation for the deposition of ink. Preconditioning of the recording medium typically prepares the recording medium for receiving ink by driving out excess moisture which can be present in a recording medium such as paper. Not only does this preconditioning step reduce the amount of time necessary to dry the ink once deposited on the recording medium, but this step also improves image quality by reducing paper cockle and curl which can result from too much moisture remaining in the recording medium.

Various drying mechanisms for drying images deposited on recording mediums are illustrated and described in the following disclosures which may be relevant to certain aspects of the present invention.

In U.S. Pat. No. 4,970,528 to Beaufort et al., a method for uniformly drying ink on paper from an ink jet printer is described. The printer includes a uniform heat flux dryer system including a 180° contoured paper transport path for transferring paper from an input supply tray to an output tray. During transport, the paper receives a uniform heat flux from an infrared bulb located at the axis of symmetry of the paper transport path. Reflectors are positioned on each side of the infrared bulb to maximize heat transmission from the bulb to the paper during the ink drying process.

U.S. Pat. No. 5,029,311 to Brandkamp et al., describes a fluorescent lamp utilized in a document scanning system which is environmentally and thermally stabilized by means of a bifurcated heater control assembly. A heater blanket is wrapped around the entire surface of the lamp including the end areas surrounding the filaments but exclusive of the aperture through which light is emitted.

U.S. Pat. No. 5,274,400 to Johnson et al., describes an ink path geometry for high temperature operation of ink jet printheads. A heating means is positioned close to a print zone for drying of the print medium. The heating means includes a print heater and a reflector which serve to concentrate the heat on the bottom of the print medium through a screen.

U.S. Pat. No. 5,287,123 to Medin et al., describes a color ink jet printer having a heating blower system for evaporating ink carriers from the print medium after ink-jet printing. A print heater halogen quartz bulb heats the underside of the medium via radiant and convective heat transfer through an opening pattern formed in a print zone heater screen.

SUMMARY OF THE INVENTION

In accordance with one aspect of the present invention, there is provided a printing machine for printing on a recording medium moving along a path through a print zone. The printing machine includes a printhead adapted to deposit ink on the recording medium and a heater lamp, disposed adjacently to the path, generating heat energy for heating the recording medium, including a first portion integral with the heater lamp directing the heat energy toward the recording medium for drying ink thereon.

In accordance with another aspect of the present invention, there is provided a printing machine for printing on a surface of a recording medium moving along a path through a print zone. The printing machine includes a printhead, adapted to deposit ink on the surface of the recording medium, a heat source, generating heat energy, disposed adjacently to the path, for heating the recording medium, and a reflector system, including a first reflector and a second reflector, the first reflector and the second reflector directing the heat energy toward another surface of the recording medium.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
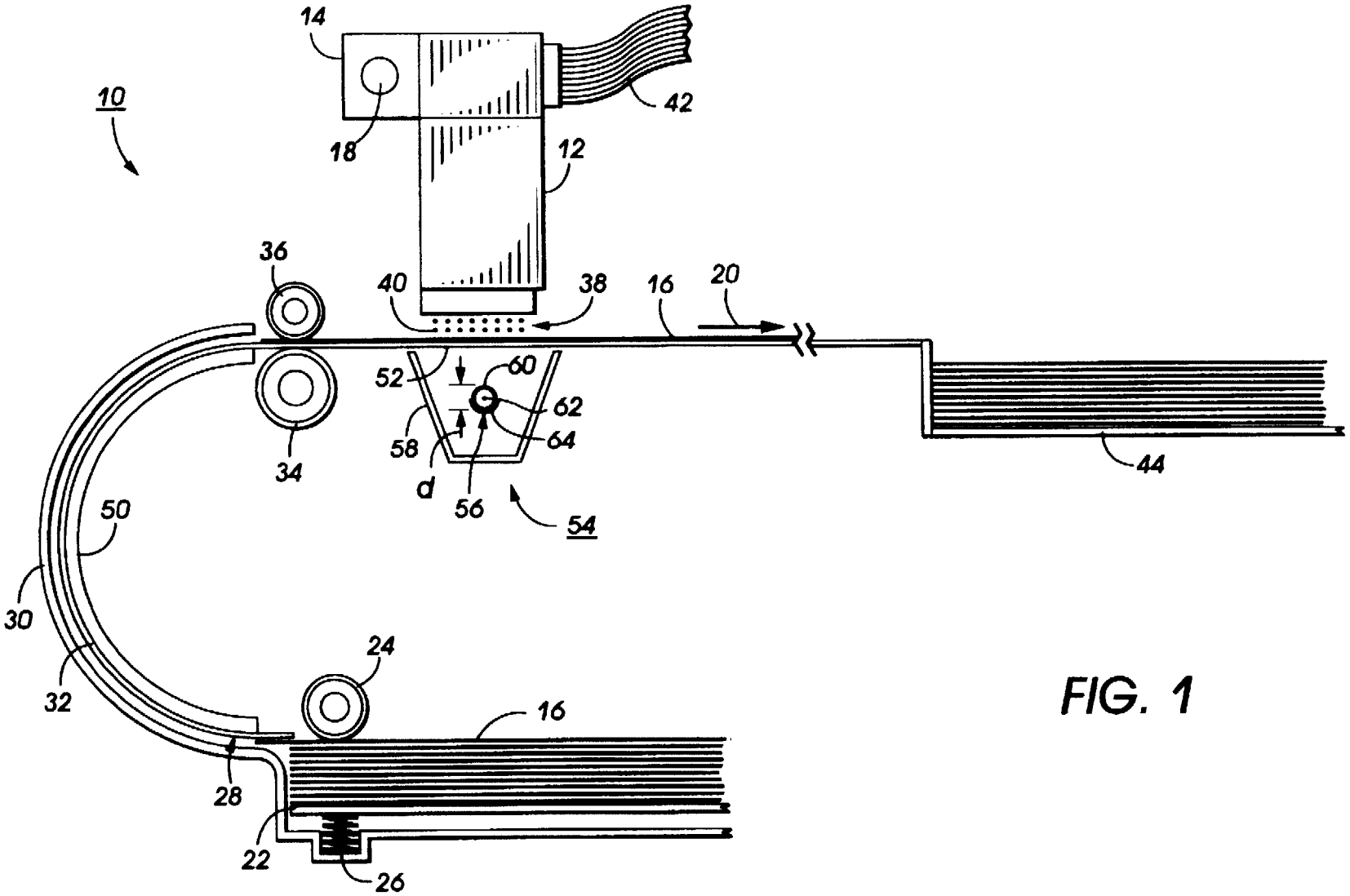
FIG. 1 is a schematic side elevational view of a liquid ink printer having a dryer with an integral reflector.

Although the present invention discussed herein may be used for drying any image which is created by a liquid ink printer, the description of the present invention will be described in the environment of an ink jet printer such as that shown in FIG. 1. FIG. 1 illustrates a schematic representation of a thermal ink jet printer 10 in a side elevation view. A translating ink jet printhead 12 printing black and/or colored inks is supported by a carriage 14 which moves back and forth across a recording medium 16, for instance, sheets of paper or transparencies, on a guide rail 18. Multiple printheads printing different colors are also within the scope of this invention. The recording medium 16 is moved along a recording medium path through the printer in the direction noted by the arrow 20. Single sheets of the recording medium 16 are fed from a tray 22 by a document feed roll 24. The document tray 22 is spring biased by a biasing mechanism 26 which forces the top sheet of the stack of recording sheets held by the tray 22 into contact with the feed roll 24. The topmost recording medium 16, in contact with the drive roll 24, is transported by the drive roll 24 into a chute 28 which is defined by an outer guide member 30 spaced from an inner guide member 32, each of which are curved to thereby reverse the direction of the recording sheets 16 for printing by the printhead 12. Once the recording medium exits the chute 28, the recording medium 16 is driven into the nip of a drive roll 34 cooperating with a pinch roll 36 to advance the recording sheet 16 into a print zone 38.

The print zone 38 is the area directly beneath the printhead 12 where droplets of ink 40 are deposited by an array of ink nozzles printing a swath of information and arranged on a front face of the printhead. The front face of the printhead is substantially parallel to the recording medium. The carriage 14, traveling orthogonally to the recording medium 16, deposits the ink droplets 40 upon the recording medium 16 in an imagewise fashion. The printhead 12 receives ink from either an attached ink tank or from an ink supply tube (not shown). The image deposited upon the recording medium 16 can include text and/or graphic images, the creation of which is controlled by a controller, known to those skilled in the art, in response to electrical signals traveling through a ribbon cable 42 coupled to the printhead 12. Before the recording medium 16 has completely left control of the drive roll 34 and the pinch roll 36, an exit drive roll/pinch roll combination (not shown) or other known means captures the leading edge of the recording medium 16 for transport to an output tray 44 which holds printed recording medium.

To fix the liquid ink to the recording medium 16, the moisture must be driven from the ink and the recording medium. While it is possible to dry the ink by natural air drying, natural air drying can create certain problems such as cockle or curl and can also reduce the printing throughput of the printer. Consequently, active drying by the application of heat energy to the printed recording medium is preferred. To improve printing quality, the present invention includes a pre-heater 50 which is located along the inside of the inner guide member 32. The heater 50 generates heat energy which is transferred to and through the inner guide member 32. In addition, a segmented flexible pre-heater, such as that described in U.S. patent application Ser. No. 08/523,322, herein incorporated by reference, having the title "Segmented Flexible Heater For Drying a Printed Image" and a filing date of Sep. 5, 1995, can also be used. The heater 50 is located within the printer 10 such that the side of the recording medium opposite the side to be printed receives the heat energy. Heat energy is delivered primarily through conduction. The inner guide section 32 can include apertures, such as round holes, diagonally placed slots, or raised areas to thereby shorten warm-up times.

Once the leading edge of the recording medium has passed the pre-heater 50, ink is deposited on the recording medium in the print zone 38. During traversal through the print zone 38, the recording medium 16 is supported therein by a support platen 52 defining a substantially planar surface with apertures (see also FIG. 2). Beneath the support platen 52 is a dryer 54 which applies heat energy to the back side of the recording medium 16 during printing. The dryer 54 provides the primary drying function of driving the liquid from the ink deposited by the printhead. The dryer 54 primarily adds heat energy to the recording medium during printing to drive excess liquid from the ink and paper. The heater 54 includes a heater lamp 56 located within a reflector housing 58. The heater lamp 56 includes a quartz tube 60 surrounding a resistive filament wire 62, such as iron-aluminum chromium alloy. The quartz tube surrounding the filament wire essentially serves as a protective device for preventing the filament wire from contacting other printer components and is a high temperature material to prevent breakage. The resistive filament disposed therein includes a length approximately equal to the width of the recording sheet 16 such that the heat energy generated by the filament wire is applied sufficiently across the width of the recording sheet as it passes through the print zone 38. In addition, the quartz tube, which is substantially cylindrical in shape, has a diameter, d, of approximately 4 millimeters. Other diameters are also possible. Tungsten iodide lamps are also within the scope of the invention.

The heat energy generated by the heater lamp 56 is directed towards the backside of the recording medium 16 by the reflector housing 58 and more importantly an integral reflector 64 located on the exterior surface of the quartz tube 60. The integral reflector 64 is a highly reflective coating, such as gold, which has been deposited upon substantially the entire length of the quartz tube 60 and on approximately 180° of the circumference thereof. The highly reflective coating 64 directs the radiant energy or heat energy generated by the heater lamp 56 more efficiently onto the print media than other known dryers of a similar type for drying liquid ink.

The reflective coating 64 is deposited on the outer circumference of the quartz tube 60 by known vacuum deposition techniques. While gold is preferred because of its high reflectivity, silver and other known reflective materials can also be used. The described tube lamp configuration increases the efficiency of the dryer 54 when used in combination with the reflector housing 58, both of which direct heat energy to the same side of the recording medium. The coating of the highly reflective material to a portion of the quartz tube acts as a very efficient reflector to direct radiant energy towards the print zone 38. The reflector housing 58, consequently, receives much less of the direct radiant energy from the lamp therefore resulting in lower reflector losses. For example, it has been shown that energy losses resulting from the absorption by a reflector alone are much greater than energy losses resulting from a reflector with the described heater lamp having the integral reflective coating.

Heat flux absorbed both with and without paper present at the reflector housing opening 58 indicates that reflective losses are much less when using the heater lamp configuration of the present invention. For instance, calculated reflector losses, without paper in the print zone, for reflector parameters based on a Hewlett-Packard Company 1200C printer, were found to be approximately 17.5%, while the reflector losses without paper for the dryer 54 were approximately 5%, a reduction of greater than three times. Likewise, when reflector losses with paper were computed for the parameters for a 1200C printer, the loss was approximately 25.4% while for the present invention the loss was 11.5%. The increased reflector absorption with paper present is caused by a portion of the energy being reflected by the paper back into the cavity defined by the reflector housing where there is greater opportunity for additional reflector loss.

The significant reduction of energy absorbed by the reflector housing translates into a number of advantages. Since there is less energy absorbed by the reflector, the printer of the present invention requires less time to reach an adequate drying temperature (less warm-up time), before printing can begin, than is necessary for other known designs. In addition, the increased efficiency of the drying system will reduce overall energy consumption as well as minimizing waste heat in the printer itself. Waste heat is an undesirable by-product of known designs and can be particularly harmful in ink jet devices since waste heat results in additional stress applied to the printhead cartridge which necessitates more aggressive temperature maintenance of the printhead. Such stresses, if left uncontrolled, result in increased unreliability of the printhead. In addition to these factors, the reflector housing 58, because of its simple design, reduces manufacturing costs since the previous designs must rely on highly reflective coatings which are typically more expensive. While the integral reflective coating of the present invention may add cost to the dryer, especially if a gold coating is used, the additional cost is not excessive since the quartz tube 60 can operate effectively with a very small diameter, d. Any additional cost is outweighed by reduced cost of the reflector housing and the advantages previously described.

Figure 2:
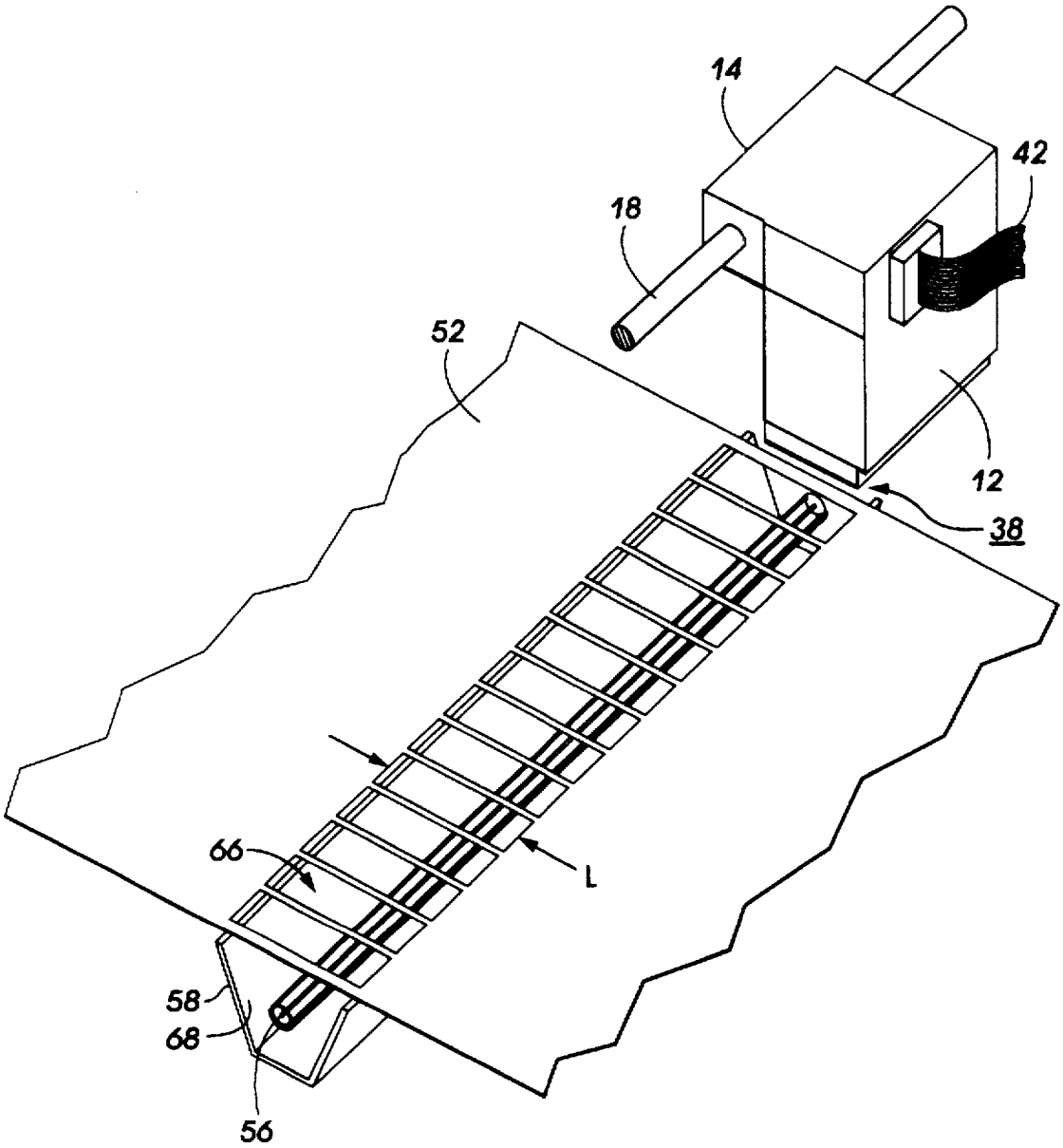
FIG. 2 is a schematic perspective view of a heater lamp having an integral reflector located within a reflector housing beneath a support platen.

FIG. 2 illustrates a schematic perspective view of the support platen 52, the heater lamp 56, and the reflector housing 58 across the width of the print zone 38. As illustrated, the support platen 52 includes a plurality of apertures 66 to allow the heat energy generated by the heater lamp 56 to impinge on the back side of the recording medium 16. It has been found that the present dryer 54 provides satisfactory drying of a printed sheet when the heater lamp 56 generates approximately 75 watts of energy and a color temperature of approximately 800°K. In addition, the power supply used to operate the heater lamp at the preferred wattage and color temperature, is preferably a low voltage power supply producing in the neighborhood of 40 volts DC. In addition, it has been found that the reflector housing 58 and the heater lamp 56 operate most efficiently when the spectral reflectivity of the interior surface 68 is approximately 0.85. In addition, it has been found that the length I of the preheat zone is preferably at least twice as wide as the swath of information being deposited by the printhead 12. Likewise, it is preferable to locate the lamp 56 within the housing 58 such that the generated heat energy focused by the reflective coating 64 is at least as wide as the length I.

Figure 3:
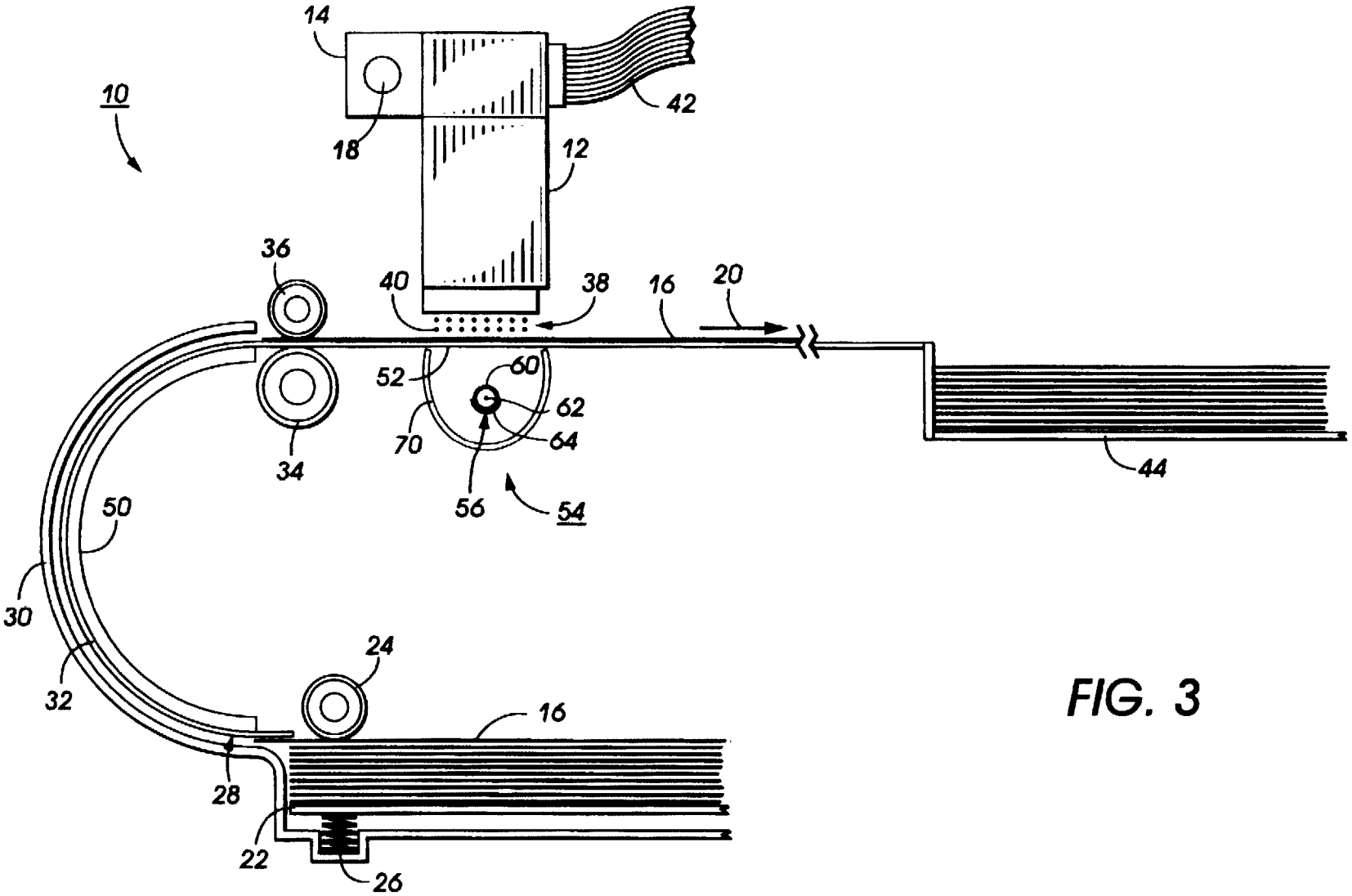
FIG. 3 is a schematic side elevational view of a second embodiment of a liquid ink printer having a dryer with an integral reflector of the present invention.

FIG. 3 illustrates a second embodiment of the heater 54 which includes an elliptical reflector housing 70 including a major axis of 25 millimeters and a minor axis of approximately 20 millimeters. As before, the heater 54, including the elliptical reflector housing, shows marked improvement in reducing overall energy absorption of the reflector.

It is, therefore, apparent that there has been provided in accordance with the present invention, a heater for drying liquid ink deposited by a liquid ink printer which not only provides for improved heat management within the printer itself but also allows for a reduction of power used by the printer. The use of a reflective coating integral with the heater lamp improves the overall dryer efficiency providing a significant technical improvement over known dryers used in commercially available ink jet and liquid printers. While this invention has been described in conjunction with a specific embodiment thereof, it is evident that many alternatives, modifications, and variations will be apparent to those skilled in the art. For instance, the present invention is not limited to the described reflector housing but includes other reflector housing configurations as well, since it has been shown that the heater lamp 56 having an integral reflective coating can significantly improve heater efficiency with different reflector housings. In addition, the integral reflective coating could be formed within the tube itself or on an interior surface thereof. Accordingly, it is intended to embrace all such alternatives, modifications and variations that fall within the spirit and broad scope of the appended claims.

What is claimed is:

1. A printing machine for printing on a recording medium moving along a path through a print zone, comprising:

a printhead, adapted to deposit ink on the recording medium in the print zone: and a heater lamp, disposed adjacently to the path, generating heat energy for heating the recording medium, including a first portion, integral with said heater lamp, directing the heat energy toward the recording medium for drying ink thereon, said first portion including a reflective material disposed on a surface of said heater lamp.

2. The printing machine of claim 1, wherein said heater lamp comprises an apertured quartz lamp.

3. The printing machine of claim 1, further comprising a reflector, spaced from said heater lamp, reflecting the heat energy generated by said heater lamp toward the recording medium.

4. The printing machine of claim 3, wherein said reflective material is disposed on an exterior surface of said heater lamp.

5. The printing machine of claim 4, wherein said reflective material is disposed on approximately one-half said exterior surface of said heater lamp.

6. The printing machine of claim 5, wherein said reflective material is disposed on said exterior surface by vacuum deposition.

7. The printing machine of claim 6, wherein said metal material comprises gold.

8. The printing machine of claim 1, wherein said heater lamp comprises a quartz tube.

9. The printing machine of claim 8, wherein said reflective material is disposed on approximately one-half of said interior surface.

10. The printing machine of claim 9, wherein the printhead prints a swath of information and said reflector defines an aperture including a dimension substantially equal to twice the width of the swath of information.

11. The printing machine of claim 10, further comprising a support platen, supporting the recording medium in the print zone and disposed across said aperture.

12. The printing machine of claim 8, wherein the diameter of said heater lamp is approximately 6 millimeters or less.

13. A printing machine for printing on a recording medium, including a first portion and a second portion, moving along a path through a print zone, comprising:

a printhead, adapted to deposit ink on the first portion of the recording medium;

a heat source, disposed adjacently to the path, generating heat energy for heating the recording medium, including a heater lamp having an exterior surface, an interior surface, and a filament disposed adjacent said interior surface; and a reflector system, including a first reflector and a second reflector, said first reflector and said second reflector directing the heat energy toward the second portion of the recording medium, said first reflector located closer to said heat source than said second reflector, said first reflector including a reflective material disposed on one of said surfaces of said heater lamp.

14. The printing machine of claim 13, wherein said reflective material is disposed on said exterior surface of said heater lamp.

15. The printing machine of claim 14, wherein said reflective material is disposed on approximately one-half said exterior surface of said heater lamp.

16. The printing machine of claim 15, wherein said reflective material is disposed on said exterior surface by vapor deposition.

17. The printing machine of claim 16, wherein said reflective material comprises gold.

18. The printing machine of claim 17, wherein said heater lamp comprises a quartz tube.

* * * * *